United States Patent [19]

Weldon

[11] 4,324,820

[45] Apr. 13, 1982

[54] METHOD AND APPARATUS FOR COATING A PAPER WEB

[75] Inventor: Scott B. Weldon, San Mateo, Calif.

[73] Assignee: St. Regis Paper Company, New York, N.Y.

[21] Appl. No.: 170,050

[22] Filed: Jul. 18, 1980

[51] Int. Cl.[3] ..... B05D 1/02

[52] U.S. Cl. ..... 427/420; 118/300; 118/325; 118/DIG. 4; 427/421; 427/424

[58] Field of Search ..... 427/420, 421, 424; 118/325, 300, DIG. 4

[56] References Cited

U.S. PATENT DOCUMENTS

| | | | |
|---|---|---|---|
| Re. 26,528 | 2/1969 | Anderson . | |
| 1,803,792 | 5/1931 | Christensen . | |
| 2,565,319 | 8/1951 | Newman | 118/407 X |
| 2,676,565 | 4/1954 | McDermott . | |
| 2,778,284 | 1/1957 | MacDonald . | |
| 3,124,504 | 3/1964 | Mahoney et al. . | |
| 3,176,543 | 4/1965 | Moore et al. . | |
| 3,198,697 | 8/1965 | Justus . | |
| 3,202,536 | 8/1965 | Brezinski . | |
| 3,236,471 | 2/1966 | Hornbostel . | |
| 3,250,671 | 5/1966 | Walker . | |
| 3,252,854 | 5/1966 | Bowen . | |
| 3,355,816 | 12/1967 | McKie et al. . | |
| 3,362,080 | 1/1968 | Daane . | |
| 3,380,669 | 4/1968 | Hatton . | |
| 3,382,143 | 5/1968 | Justus et al. . | |
| 3,383,062 | 5/1968 | Meihofer et al. . | |
| 3,387,384 | 6/1968 | Sutton . | |
| 3,387,708 | 6/1968 | Saloman et al. . | |
| 3,405,855 | 10/1968 | Daly et al. . | |
| 3,418,970 | 12/1968 | Phelps et al. . | |
| 3,419,203 | 12/1968 | Amend, Jr. . | |
| 3,447,453 | 6/1969 | Rojecki . | |
| 3,450,596 | 6/1969 | Green . | |
| 3,453,137 | 7/1969 | Penkala et al. . | |
| 3,459,124 | 8/1969 | Notbohm . | |
| 3,468,242 | 9/1969 | Schaffrath . | |
| 3,471,367 | 10/1969 | Chupka . | |
| 3,483,079 | 12/1969 | Beachler . | |
| 3,483,080 | 12/1969 | Notbohm . | |
| 3,492,741 | 2/1970 | Witworth . | |
| 3,519,532 | 7/1970 | Sutherland . | |
| 3,528,882 | 9/1970 | Notbohm . | |
| 3,537,954 | 11/1970 | Justus . | |
| 3,552,355 | 1/1971 | Flint | 118/657 X |
| 3,563,852 | 2/1971 | Rojecki . | |
| 3,565,759 | 2/1971 | Notbohm et al. . | |
| 3,572,361 | 3/1971 | Terhar et al. . | |
| 3,573,161 | 3/1971 | Notbohm . | |
| 3,573,162 | 3/1971 | Brezinski . | |
| 3,574,055 | 4/1971 | Gustafson . | |
| 3,575,800 | 4/1971 | Beck . | |
| 3,578,556 | 5/1971 | Notbohm et al. . | |
| 3,578,559 | 5/1971 | Beck . | |
| 3,578,561 | 5/1971 | McCarrick et al. . | |
| 3,586,253 | 6/1971 | Gilbank et al. . | |
| 3,597,315 | 8/1971 | Notbohm et al. . | |
| 3,598,697 | 8/1971 | McKie et al. . | |
| 3,604,646 | 9/1971 | Keyes et al. . | |
| 3,610,137 | 10/1971 | Brafford . | |
| 3,610,541 | 10/1971 | Gudaz . | |
| 3,619,362 | 11/1971 | Parker . | |
| 3,654,075 | 4/1972 | Keyes et al. . | |
| 3,654,896 | 4/1972 | Marx et al. . | |
| 3,708,389 | 1/1973 | Maitra . | |
| 3,734,822 | 5/1973 | Bennett et al. . | |
| 3,737,962 | 6/1973 | Hill . | |
| 3,740,312 | 6/1973 | Cronin . | |
| 3,752,734 | 8/1973 | Notbohm . | |
| 3,762,991 | 10/1973 | Justus . | |
| 3,772,145 | 11/1973 | Notbohm . | |
| 3,778,908 | 12/1973 | Notbohm . | |
| 3,795,082 | 3/1974 | Brenner et al. . | |
| 3,800,381 | 4/1974 | Brafford . | |
| 3,839,147 | 10/1974 | Daane . | |
| 3,839,148 | 10/1974 | Beck . | |
| 3,844,820 | 10/1974 | Shaffer et al. . | |
| 3,846,228 | 11/1974 | Ely . | |
| 3,853,694 | 12/1974 | Parker . | |
| 3,855,057 | 12/1974 | Hill . | |
| 3,856,618 | 12/1974 | Roell . | |
| 3,861,997 | 1/1975 | Ely . | |
| 3,884,362 | 5/1975 | Brenner et al. . | |
| 3,923,402 | 12/1975 | Turcotte . | |
| 3,950,988 | 4/1976 | Nowisch et al. . | |
| 3,964,860 | 6/1976 | Leifeld | 118/325 X |
| 4,030,971 | 6/1977 | Justus . | |
| 4,122,209 | 10/1978 | Kinard | 118/657 X |

OTHER PUBLICATIONS

Inter-Office Memo of St. Regis dated 10/28/76, regarding Twin Blade Coater Demonstration.

Pigmented Coating Processes for Paper and Board; Tappi Monograph Series No. 28 (1964) pp. 3-62.

Sales Brochure of Black Clawson/Converting Equipment, Fulton, New York regarding Jet Fountain Applicator.

Sales Brochure of Technology Marketing Incorporated, Montvale, New Jersey regarding Twinblade.

Sales Brochure of Jagenberg USA Inc. New York, New York regarding Jagenberg Blade Coaters Model GSM.

Blade Coating Technology: Supplement to Monograph #28 "Pigmented Coating Processes", Ed. C. Wells Clark, Tappi Press (1979) pp. 1-4.

*Primary Examiner*—Shrive P. Beck

*Attorney, Agent, or Firm*—Nicholas L. Coch; Joseph M. Maguire

[57] ABSTRACT

A moving substrate material such as a web of paper, paperboard, film, or other substance is covered with a coating by propelling a coating material onto a deflector bar positioned near the substrate material. The deflector bar is configured to deflect the coating material toward the moving web in a continuous, free standing, smooth jet curtain of coating material. The coating on the web is free of skips, scratches, and other imperfections. In one embodiment, propulsion of the coating material toward the bar is accomplished by rotating a drum, or applicator roll, through the coating material. The surface of the drum or roll carries the material to the deflector bar at a speed and in a sufficient quantity to cause the material to be deflected by the bar in a continuous free standing curtain toward the paper web.

28 Claims, 11 Drawing Figures

OPERATING CHARACTERISTICS OF HIGH VS. LOW EFFICIENCIES JET BARS
FLOW RATES VS. ENERGY REQUIRED TO FORM A CONSTANT HEIGHT JET

OPERATING CHARACTERISTICS OF HIGH VS. LOW EFFICIENCIES JET BARS
JET HEIGHT KEPT CONSTANT WHILE APPLICATOR ROLL VELOCITIES AND COATING FLOW RATES WERE VARIED

METHOD AND APPARATUS FOR COATING A PAPER WEB

BACKGROUND OF THE INVENTION

This invention relates generally to coating substrate materials and more specifically, to a method and apparatus for providing a smooth, uniform coating on a web of paper, paperboard, film or other substances.

Coating a web of paper is generally effected by the application of a fluid coating material to a moving web. The material may be composed of a solid constituent suspended in a liquid carrier or vehicle. In one example, a pigment composition such as clay, calcium carbonate, aluminum powder, together, with an adhesive component such as starch, latex, casein, vegetable protein or equivalent are suspended in an aqueous vehicle.

The quality of coating on the paper depends upon many factors, one important factor being how the material is applied. The application of the coating material should preferably result in a coating that is continuous and uniform across the web. The coating material, varying in viscosity and solids content according to desired use, has previously been applied to the moving web in several ways.

One method previously employed was to feed the coating material to applicator rolls that applied the material directly onto the moving web. While the use of applicator rolls would initially yield a finished uniform coating across the web, as the process continued there occurred an eventual build up of coating material, dirt and other foreign substances on the rolls themselves that caused scratches and other imperfections in the coating. Direct application by rollers also created forces which imbedded the coating material into the web, and other drawbacks.

In an attempt to avoid these and other problems, the art developed a coating process in which the coating was jetted directly onto the moving web with a die fountain nozzle. While this process overcomes some of the limitations of roll applicators, die fountain nozzles require elaborate hydraulic mechanisms to create a uniform jet and, for some coating materials, elaborate coating/air separation equipment. Moreover, such process also requires special filtering apparatus and has a limited color viscosity and solids ranges.

Another important consideration in any coating application process is the velocity of the coating material as it is delivered from the carrying medium to the web surface. Because the web is moving during the process and because the coating material must be applied to the full width of the moving web, it is essential that the coating material be delivered with a uniform velocity across the entire width of the web. A jet from a fountain nozzle has a tendency to have less than a uniform velocity profile in the cross machine direction because of the inherent engineering problems in the equipment used to form the free steady jet fed from a pipe.

In addition to the objective of achieving a continuous, uniform coating on the web, the cost of achieving this goal, and the availability of an apparatus to handle a wide range of color solids content and viscosity are also of importance. It is also highly desirable to accomplish the result with a simple apparatus.

It is the primary object of the invention to provide an apparatus for applying a color coating onto a paper web, which apparatus is simple in construction and economical to operate and which is capable of applying a continuous, uniform coating across the web.

It is another primary object of this invention to provide an economical process for coating a substrate wherein a continuous application of coating material is achieved by delivering the coating material at a uniform velocity as it leaves its carrying medium to a deflector bar and then to the substrate.

It is a further object of the invention to provide an apparatus and process for applying color coating material on a web of paper by generating a continuous free standing jet curtain of coating material.

It is a further object of the invention to provide an apparatus and process for applying color coating material on a web of paper by generating a continuous free standing jet curtain and a coating of excellent quality over a wide range of solids content and viscosity of the coating material.

DESCRIPTION OF THE INVENTION

The method of the invention is accomplished by propelling a coating material to a deflecting mechanism and then onto the substrate to be coated. The deflecting mechanism is a bar positioned to receive the moving fluid material and redirect it toward and onto the moving web. The bar is positioned and specially configured to deflect the coating material in a continuous free standing jet curtain of excellent integrity to provide the desired coating on the web substrate.

It has been found that a free standing jet curtain of coating material is most efficiently and best formed by using an elongated bar, having a short flat wall, positioned perpendicular to the oncoming coating material. The bar may also have various geometrical configurations, such as a parabola, a hyperbola, or the like having a first portion which extends generally perpendicular to the direction of the oncoming coating material and a second portion integral therewith and placed at an angle to the first and extending generally in the direction in which the material is to flow to the web. The bar deflects and propels the fast moving coating material toward the paper web in a continuous, free standing jet curtain of sufficient height and width to impinge on and coat the web. It has been found that the degree of change in direction of the deflected coating material, measured as the angular difference between the incoming coating material and the exiting jet, should preferably be greater than 45° and less than 145°. It has further been found that the angular difference between the exiting formed jet and the upper non-wetted surface of the jet bar should be at least 45° and preferably greater to promote establishment of a free standing jet. At certain levels of low vertical velocity of the free standing jet at the web coating interface, it have been found preferable to direct the free standing jet toward the paper web at an angle of at least 11° on either side of the vertical, to enhance stability of the jet.

Delivery of the coating material to the deflector bar at the proper speed and in the appropriate quantity may be achieved in several ways. To achieve a continuous uniform free standing jet curtain, it has been found that the leading edge of the coating material should be delivered to the deflector bar at a uniform velocity. In the preferred embodiment, this uniform velocity is achieved by using a rotating drum. The coating material is stored in a container with an open top. A drum, or cylindrical applicator roll, is positioned in the container with a part of the outer surface of the drum submerged in the coating material and a part extending through the open portion. The drum is rotated about its longitudinal axis and the coating material is continuously carried on its outer surface from the reservoir of coating material past a metering device that is mounted adjacent the drum. This device presses, in a straight line across the entire length of the drum, on the coating material smoothing and controlling its flow rate and thickness. The smooth coating material, of proper rate and thickness, moves on the surface of the drum to the deflector bar which is positioned close to the outer surface of the drum. Most of the material is deflected upward or outward in a free standing jet. A small portion of coating material passes between the bar and the drum to provide lubrication and avoid wear on and possible tearing of apparatus. The speed at which the coating material is delivered to the bar may be regulated by the speed of rotation of the drum.

DESCRIPTION OF THE DRAWINGS

In FIG. 1, one embodiment of the apparatus of the invention is schematically illustrated and is generally designated by the numeral 10. A web 12 is directed around a backing drum 16. The web 12 is moved over this drum by a conventional driving device (not shown) in a direction illustrated by the arrow 20. The web 12 passes an applicator roll 22 but is displaced from it by a small distance. The applicator roll 22, has an elongated cylindrical shape (illustrated in FIG. 2), and is rotated about its longitudinal axis in a counter-clockwise direction as viewed in FIG. 1.

A container 24, having an open upper end 26, houses a coating material 28 which is to be applied to the web 12. The roll 22 is positioned extending through the open end 26 of container 24 so that a portion 30 of the outer surface is immersed in the coating material 28. As shown in FIG. 1, some portion of the outer surface of roll 22 will always be immersed in the coating material 28 as the roll 22 rotates. The coating material adheres to the outer surface and is carried upwardly on the surface.

Figure 1:
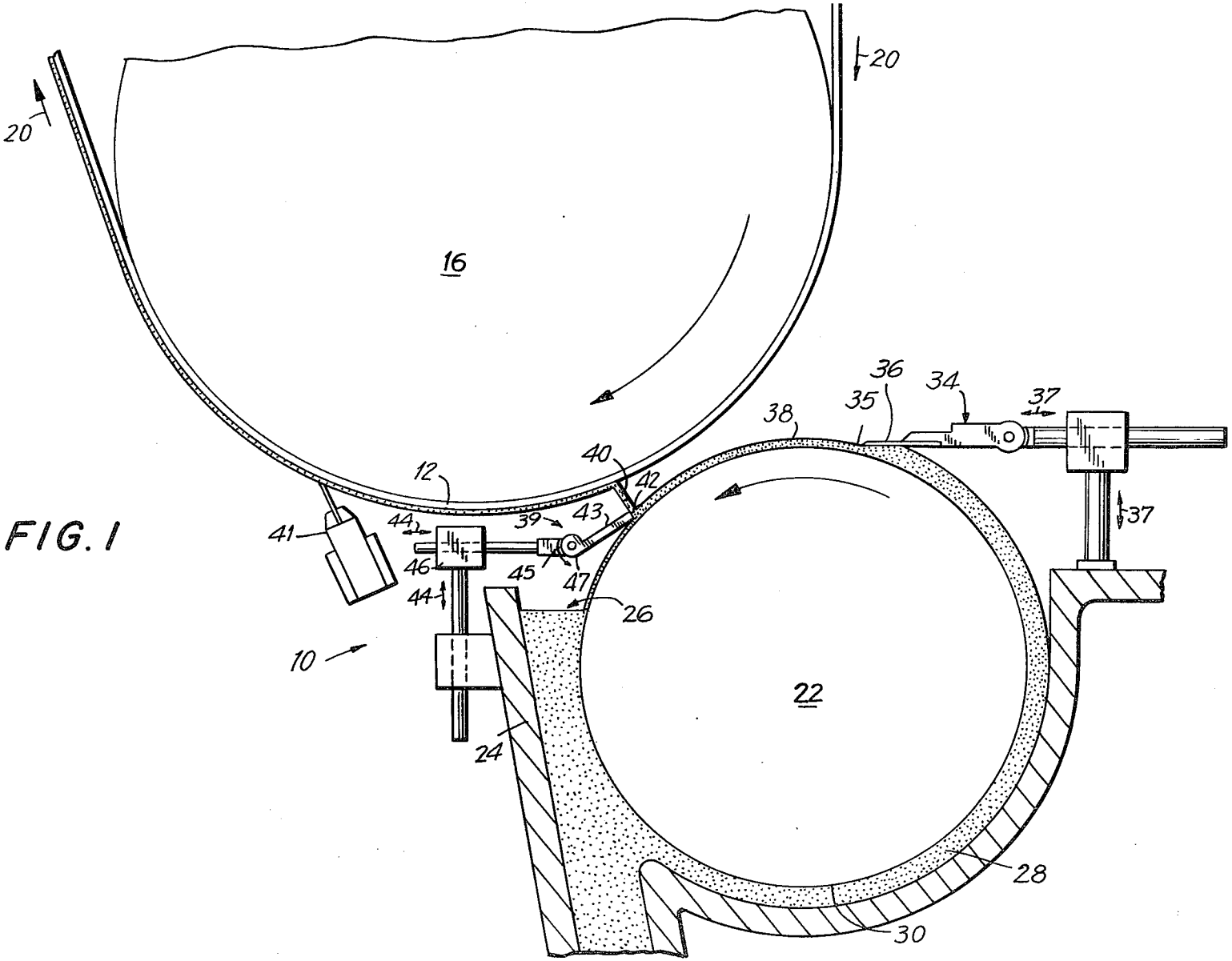
FIG. 1 is a schematic side sectional view of one embodiment of the invention.

A metering device 34 is positioned on the container 24 where the roll emerges from the reservoir of coating material. It includes a blade 36 that extends across the entire length of the roll 22 and is adjustably positioned near the surface of the roll to engage the sheet of coating material carried on the roll. This forms a nip 35 with applicator roll 22 which causes the coating material to flood the region between the metering device blade 36 and the roll 22. The metering device 34 may be moved into or out of contact with the roll 22 and rotated as shown by the arrows 37. Pressure between the blade 36 and the coating material on the roll controls the thickness of the coating material 38 that continues to travel on the roll past the blade 36. The ultimate jet curtain is a function of the thickness of the coating material as it leaves the metering device 34 and the speed of the roll 22.

This layer of coating material 38 is carried on the surface of roll 22 beyond the metering device 34 towards a deflector bar 39. The deflector bar 39 deflects the coating material 38 upwardly in a continuous free standing curtain 40, onto the moving web 12 and so coats the web. An air knife or equivalent mechanism 41 positioned at roll 18 is employed to further smooth the coating.

In practice, bar 39 should be longer than web 12 and shorter than roll 22, blade 36 should be longer than roll 22 and shorter than drum 16, and drum 16 should be longer than web 12.

Figure 2:
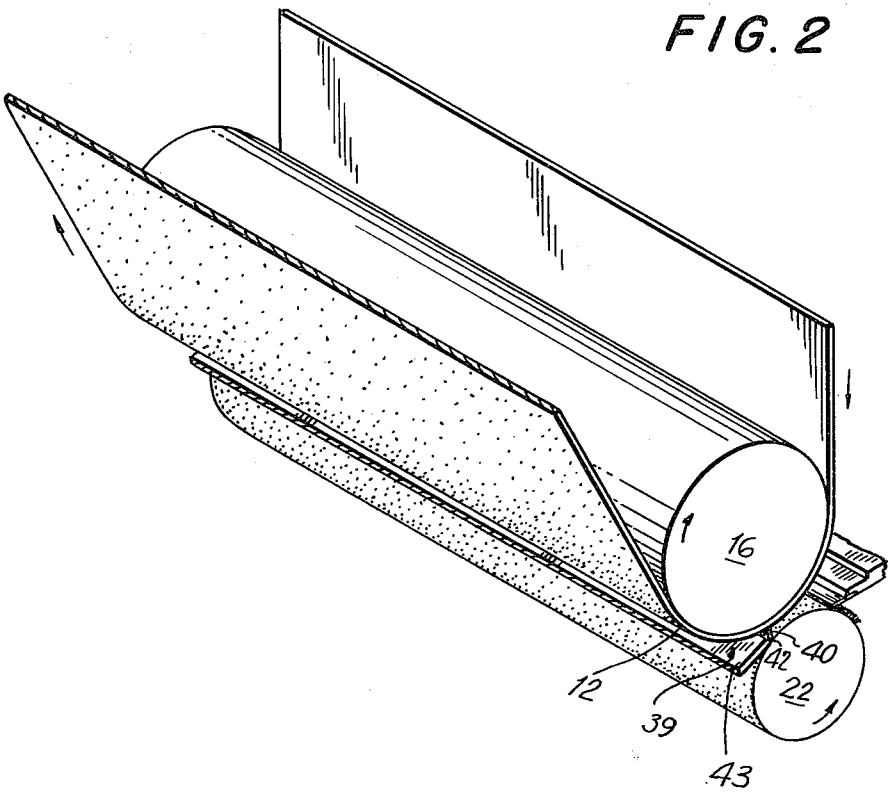
FIG. 2 is a schematic perspective view of the roll, deflector bar, and web, of FIG. 1.

The operation of the apparatus of the invention and a further understanding of the method of the invention is also described by referring now to FIG. 2. As shown in FIG. 2, the deflector bar 39 is an elongated member which extends the entire length of roll 22. The bar 39, in one of its preferred embodiments, has a blade 43 and a substantially straight, flat front surface 42 upon which the leading edge of the coating material travelling at a uniform velocity across its width and thickness impinges and is deflected. The coating is thereafter propelled upwardly from the surface 42 in a free standing jet curtain 40 and onto the moving web 12.

The position of the surface 42 may be adjusted in several directions as shown in FIG. 1. As there illustrated, the bar is held in position by adjustable member 46 and a rotatable member 47. Thus, the tension of the blade 43 and its end surface 42 can be adjusted to maintain the blade surface 42 stationary during operation. The angle at which the blade surface meets the roll 22 may also be adjusted by movement of adjustable member 46 and rotation of rotatable member 47 as shown by the arrows 44 and 45 respectively.

The use of the deflector bar in the manner described overcomes many disadvantages of prior art devices. One of the primary disadvantages of these prior art devices is that there is little possibility of avoiding skips or voids in the coating material as it is applied to the moving web. This in the prior art was due to the material being applied directly to the web by spraying, brushing or the like and therefore delivery of the material to the web was dependent on the integrity of the material being propelled by applicator roll, nozzle, etc. In the present invention, skips or voids in the coating material which naturally occur as the material adheres to the surface of the rotating applicator roll 22 are not transmitted to the web because of the intermediate action of the deflector bar. It is believed that as the coating material 38 impinges the bar 39, there is a tendency for the material to move first laterally along the bar thereby filling in any voids which may be present. In effect, the material forms a coherent mass as it is collected from the rotating surface, and thus has as much integrity as when it was lying in container 24. This integral mass of material collected at the leading edge of the bar is then propelled in this form over the surface of and beyond the exit edge of the bar without losing its integrity. Thus, it is delivered to the web 12 in a continuous free standing curtain, free of any voids or skips. Skips or voids deliberately introduced for testing of as much as ½ inch on the surface of roll 22, were eliminated entirely when the material was passed the bar 39.

Deflector Bar Configurations and Methods

It has been found, within the parameters previously discussed, that the deflector bar may have different configurations and still produce good, smooth, uniform, free standing jet curtains. The bar illustrated in FIGS. 1 and 2 is a relatively thin, flat bar with a vertical front face. A bar of this configuration used for applying color coating material onto a paper web is about three to four inches wide. The front surface 42 upon which the coating material impinges, is about 3/32 inch to ¼ inch high. The length of the bar will vary with the width of the web to be coated. The lower face or the lower leading front edge of the bar is kept contiguous with the applicator roll uniformly across its entire length by applying a torque to the bar thereby avoiding any difficulties of warping along its length. This torque may be applied by adjusting the rotable member 47 and adjustable member 46. The bar material may be selected from many kinds of materials so long as the face upon which the coating material impinges presents a smooth finish. Materials such as wood, high molecular weight polyethylene and LUCITE have been successfully employed. Non-corrosive metals such as stainless steel appear promising.

Figure 3:
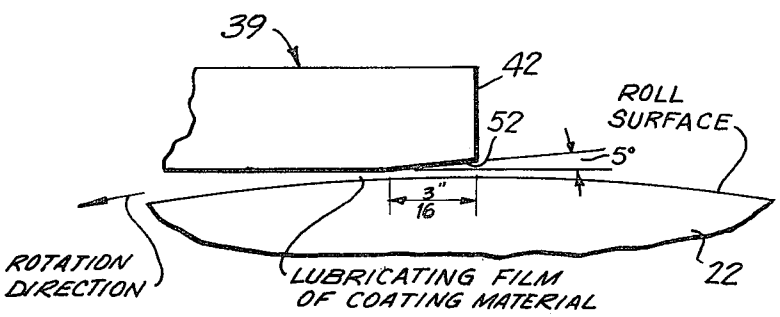
FIG. 3 is a schematic exploded side elevational view of the deflector bar of FIG. 2 with a slight angle cut at the lower portion to improve lubrication.

FIG. 3 is a side view of the leading portion of the bar 39. The front portion 52 of the lower face of bar 39 has been cut at an angle of about 5° for a distance of about 3/16 inch across the entire length. This causes a bearing film of coating material to form under the bar during the process. The film forms under the entire length of the bar and provides a lubricating action so that wear of the bar and the roll is minimized.

Figure 4A:
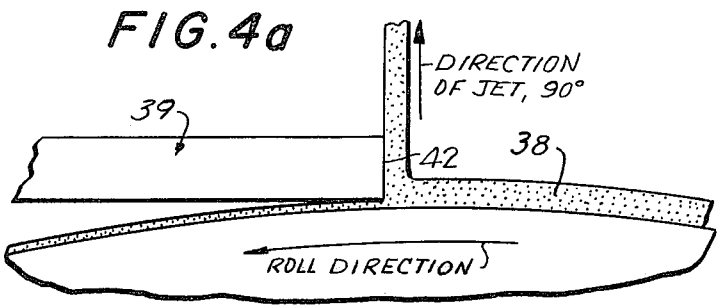
Figure 4B:
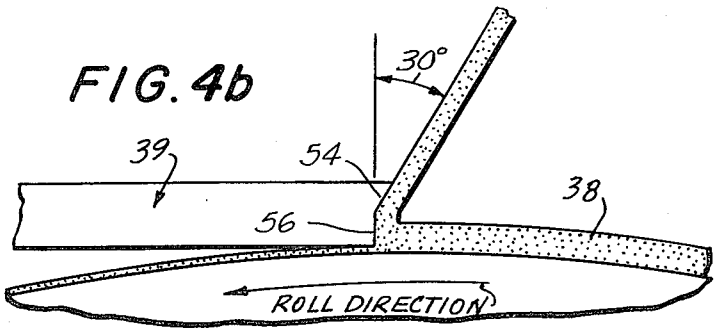

FIGS. 4–7 illustrate different deflector bar configurations useful in the invention. FIG. 4(*a*) is a detail of a butt ended bar face similar to FIGS. 1–3. In FIG. 4(*b*) a bar face similar to FIG. 4(*a*) is illustrated but includes a 30° angled flat front surface portion 54 in the bar face above the initial impingement surface 56.

Figure 5:
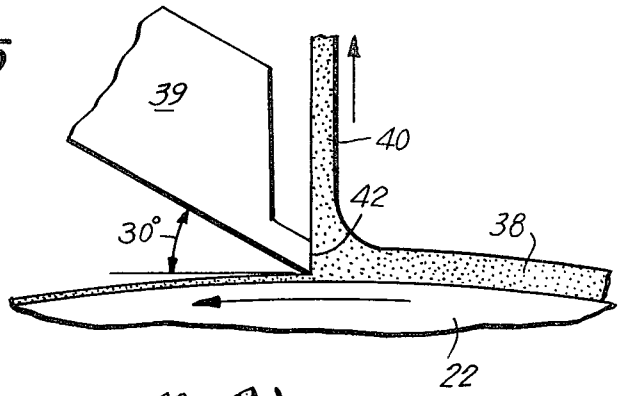
FIGS. 4–7 are side elevational views of other deflector bars suitably employed in the subject invention.

In FIG. 5, front face 42 of the bar, on which impinges the coating material is angled 60° and the entire bar is canted 30° from the roll (or the tangent to the roll) so that the face itself is impinged by the coating material at a right angle.

Figure 6:
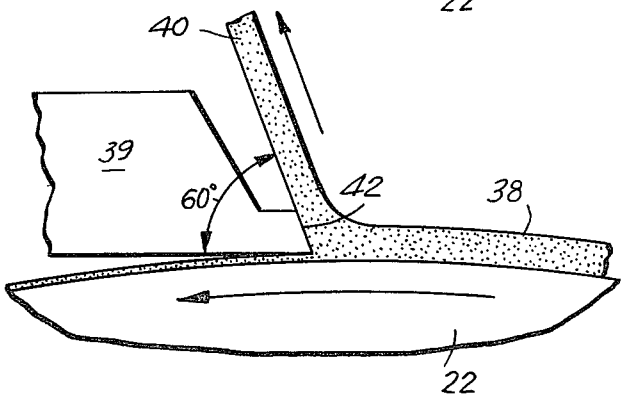

FIG. 6 is similar to FIG. 5 except that the bar is not canted at a 30° angle to the coating material.

Figure 7:
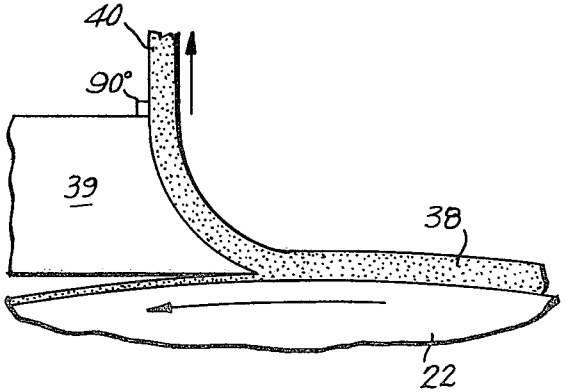

FIG. 7 illustrates a uniformly sloped front face of the bar.

Figure 8:
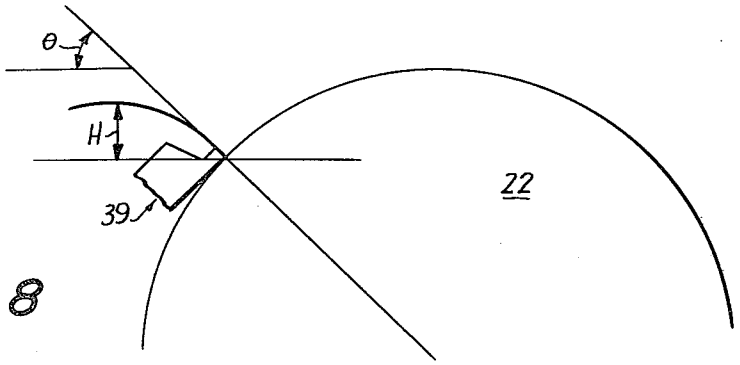
FIG. 8 is a diagram of the applicator roll, the deflector bar, and the jet curtain, illustration measurements of the curtain.

It has been found that the butt ended bars illustrated in FIGS. 1–6 are more efficient, i.e., require less energy, to form a given free standing jet curtain than the bar configuration illustrated in FIG. 7. The energy of the jet curtain has been determined to be a function of the height "H" of the jet and the angle "$\theta$" at which the jet is being cast as illustrated in FIG. 8. Theoretically, the potential energy of the jet = Mg H (Sin $\theta$) and the kinetic energy of the coating before it impinges on the bar is = $\frac{1}{2}MV^2$ where H = the upper height of the jet curtain before falling over $\theta$ = the angle the jet curtain is cast off to the horizontal M = unit mass of coatings (slugs)

g = constant

V = velocity of the roll.

The efficiency of the bar is thus the ratio of the kinetic energy of the exiting jet (the theoretical potential energy) and the kinetic energy of the coating before it impinges upon the bar.

$$\text{Efficiency} = \frac{MgH(\text{Sin }\theta)}{\frac{1}{2}MV^2} = \frac{2gH(\text{Sin }\theta)}{V^2} \qquad \text{EQUATION I}$$

The relative efficiencies of the various jet bar configurations shown in FIGS. 3–7 were determined and are summarized as follows:

| | Description | Efficiency |
|---|---|---|
| FIG. 4 | (a) configuration | 0.55 |
| FIG. 4 | (b) configuration | 0.55 |
| FIG. 5 | configuration | 0.48 |
| FIG. 6 | configuration | 0.36 |
| FIG. 7 | configuration | 0.19 |

In another set of experiments, it was determined that, with the butt-ended jet bar faces as shown in FIGS. 4(*a*) and (*b*), the efficiency of the bar significantly increases as the bar becomes thinner until it becomes too thin with respect to the coating thickness and the jet curtain then becomes unstable. Using bar thicknesses of 1/16", ⅛", 3/16" and ¼ it was found that the ⅛" thickness bar was the most efficient and the 1/16" bar too thin for a coating thickness of 1/16". A ratio of thickness of the bar to coating in the range of 1.7 to 2.5 is satisfactory.

In another experiment using a jet bar similar to that shown in FIG. 4(*b*), the coating was deflected by the upper half of the bar up to 30° without significant efficiency deterioration.

The position of the deflector bar 39 relative to the roll 22 depends upon the variables of coating material, thickness and roll velocity. Good results have been achieved by placing the deflector bar leading edge just below top dead center of the applicator roll (between the ten o'clock and eleven o'clock position as viewed in FIG. 1) with the upper edge of face 42 being between 3/16 inch and three inches from the web.

Coating Materials

The application of a suitable free standing curtain and the resulting coating on the moving web 12 depends upon a number of factors in addition to the configuration of the deflector bar: the solids content and viscosity of the coating material; coating material thickness and applicator roll speed; position of the deflector bar; and distance between the deflector bar and the moving web.

Coating material having a solid content of between 44% and 68%, with viscosities of between about 880 centipoises and 5100 centipoises have been found to be quite suitable for use in the invention. The following materials have been successfully employed.

| Constituent | Parts | | |
|---|---|---|---|
| Delaminated Clay | 60 | 60 | 80 |
| #2 Clay | 40 | 40 | — |
| Titanium Dioxide | — | — | 6 |
| Polystyrene Plastic Pigment | — | — | 14 |
| Starch | 13 | 6 | 16 |
| SBR Latex | — | 3 | — |
| Percent Solids | 58 | 68 | 44 |

While the above formulations are representative of standard pigment printing grade coatings, it will be appreciated that a large number of other fluid coating materials could be suitably employed in the subject invention, including coatings for dielectric papers, coatings to improve oil or water holdout on papers, solvent coatings, coatings for film or plastics, and the like. The ability to use such a large variety of coating materials is an advantage of this invention. This is particularly true of high solids content materials which substantially decrease the cost of coating because of reduced drying and its concommitant costs.

Coating Thickness and Flow Rates

The thickness of the coating material impinging the bar face 42 is controlled by the metering device 34. It has been observed that when the coating material thickness was increased, the height of the jet curtain also increased. This observation indicates that jet bar has a range of efficiencies depending upon flow rate and speed. This would appear to be contradictory to Equation I, since that equation indicates that the mass flow rate should not effect the theoretical height. It is believed that this may be explained by a loss of energy only at the bottom of the layer of the coating material moving over the bar face 42. As the coating material approaches the bar face, its velocity profile is uniform across its thickness and width. At the bar face, it is believed, much energy is lost due to the shearing of the coating, and that the greatest loss of energy occurs in the coating material closest to the bar face 42. Thus, any addition of coating material (i.e., increased thickness) would apparently not be effected and the net average energy of the thicker coating material is increased.

The flow rates of the coating material may be controlled by the metering device and the speed of the applicator roll. Using color coating material readily used in the paper industry, flow rates may be adjusted for 0.6 to 3.0 gallons/inch. When using the higher efficiency bars, the present invention is capable of operating at flow rates which are lower than the die fountain coater thus giving the ability to obtain better coat weight control at high speeds. In various experiments and using the coating formulation set forth above, an applicator roll with a diameter of 16 inches was rotated at a surface speed of between about 500 to 660 feet per minute and produced a continuous free standing jet curtain of heights of from three to seven inches.

Power Requirements, Position and Configuration of the Deflector Bar

Another set of experiments were run to determine the different power requirements necessary for use of a relatively low efficiency bar versus a high efficiency bar on the apparatus shown schematically in FIG. 1. The applicator roll had a diameter of 16 inches and was 50 inches long. A color coating material composition of 100 parts clay, 8 parts starch, and 1 part calcium stearate having a solids content of 56.5% and a viscosity of 45 cps (Haake Std. rheogram) was used in all runs. In one set of experiments, the coating flow rate was held constant at 1.80 gal/minute-inch, the coating thickness was held constant at 1/16", and the applicator roll was held constant at 570 fpm. The coating material was impinged upon a butt ended bar ⅛" thick as illustrated in FIG. 8 at an angle $\theta$ of 67° from the horizontal and a curved bar 1" thick as illustrated in FIG. 7 at approximately the same angle. The vertical height of the jet curtain formed was measured at 6.0 inches and 2.75 inches respectively (H in FIG. 8), thus confirming the different efficiencies of the bar.

In another similar set of experiments using the same bars, the coating parameters (viscosity, solids and thickness) and the angle at which the coating exited from the bars was held constant, but the applicator roll speed and the coating flow rates were varied so as to form a jet curtain having a height of 3.4 inches. To form a jet curtain, a certain amount of energy must be imparted to the coating material. This energy is provided by the applicator roll as it brings the coating material to the roll's velocity. The rate at which the energy is being imparted is thus the power required to form the jet. The energy of a unit mass of coating $\overline{m}$ is:

$$E_{\overline{m}} = \tfrac{1}{2}\overline{m}\, v^2$$

where:

V = applicator roll velocity (ft/sec.)

$\overline{m}$ = unit mass of coating (slugs)

$E\overline{m}$ = energy of a unit mass of coating (ft-lb)

and by definition:

$$\text{Power} = dE/dt$$

For the coating on the roll:

$$\text{Power imparted to the coating} = \frac{d(\tfrac{1}{2}\overline{m}V^2)}{dt}\ \frac{(\text{Ft/lb})}{(\text{sec})}$$

Since V is a constant:

$$\text{Power imparted the coating} = \tfrac{1}{2}V^2\frac{d\overline{m}}{dt}\ \frac{(\text{Ft/lb})}{(\text{sec})}$$

but dm/dt is the mass flow rate of the coating, which is a known constant value measured during the experiment. Thus, $$\text{Power imparted to the coating} = \tfrac{1}{2}V^2 M\ \frac{(\text{Ft/lb per foot of width})}{(\text{sec})}$$

where M = mass flow rate of the coating.

Figure 10:
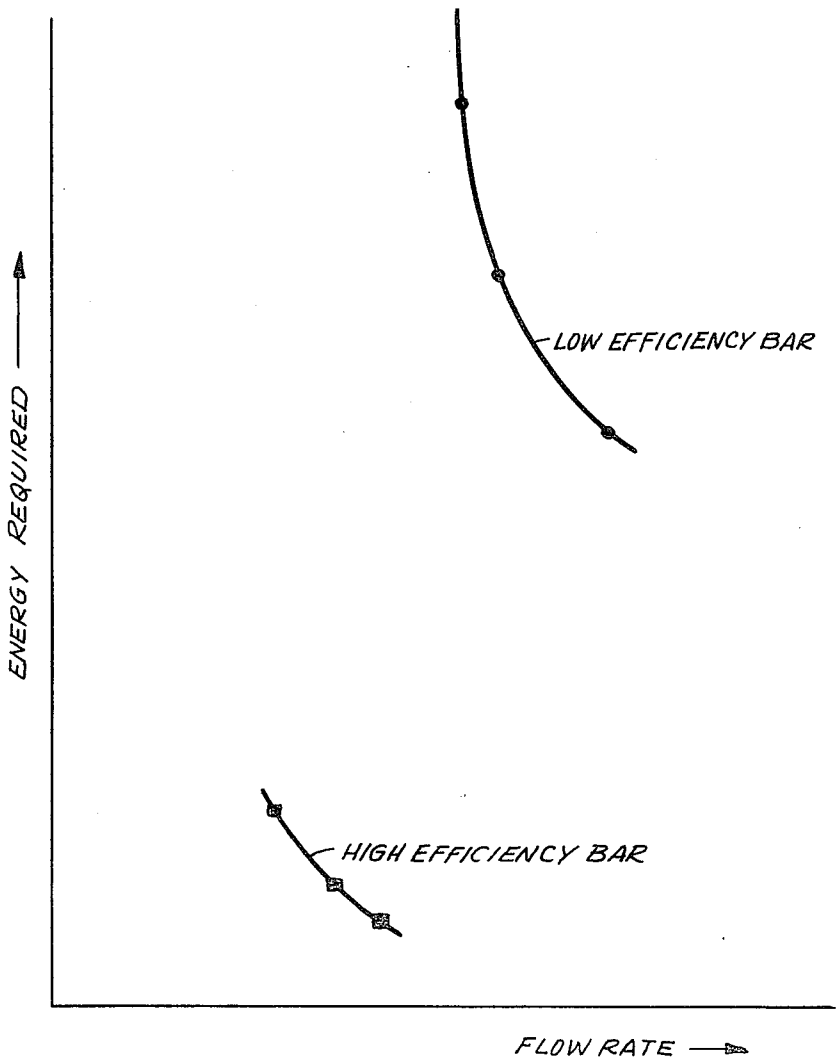
FIGS. 9 and 10 are graphs showing the relations between coating material flow rate and applicator roll speed; and flow rate and efficiency, respectively.
Figure 9:
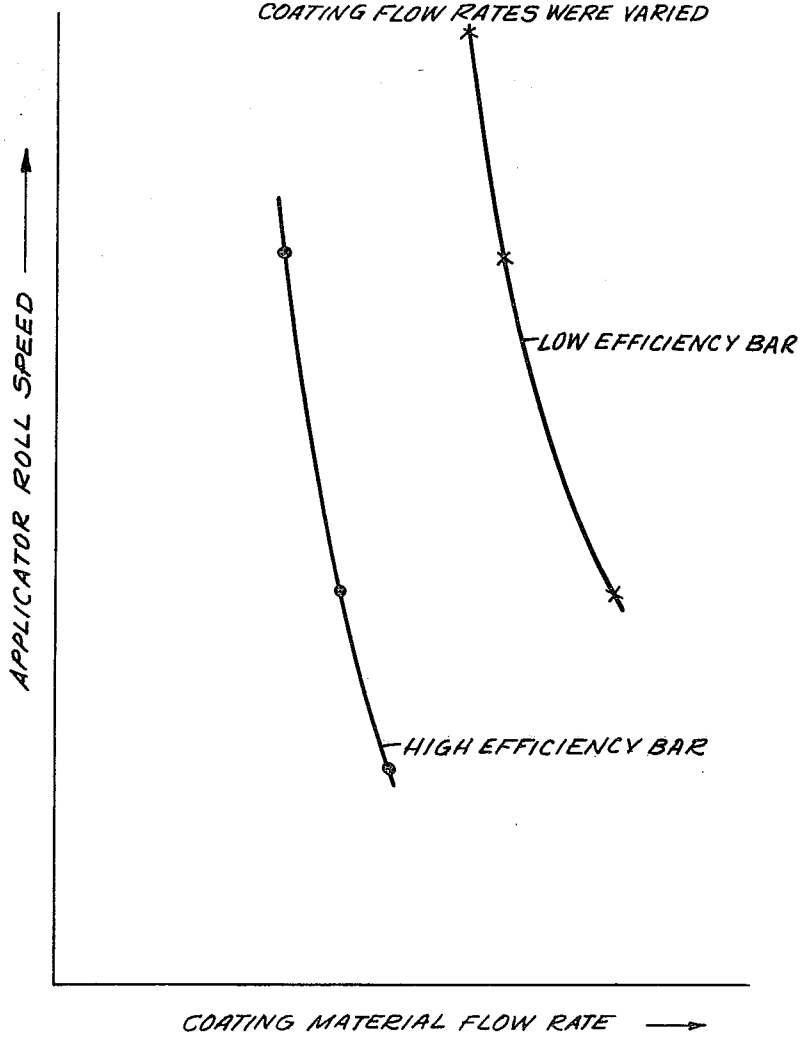

The results of the experiments are plotted in FIGS. 9 and 10. In FIG. 9, the coating material flow rate versus applicator roll speed are plotted; and in FIG. 10 the coating material flow rate versus energy required are plotted. From FIG. 9, it is seen that the coating material flow rate at a given velocity must be nearly doubled for the lower efficiency curved bar, as compared to the higher efficiency butt ended bar to make a jet curtain of the same height. Low coating material flow rates are preferred as the pumping, filtering and piping requirements of the system are reduced. As shown in FIG. 9, the applicator roll speed must be increased to reduce the flow rate. As seen in FIG. 10, the reduced flow rate increases the power required.

From the foregoing, it will be appreciated that the method and apparatus of the invention provide clear advantages over prior art methods and apparatus. The subject invention is capable of employing coating compositions with a high solid content with low energy requirements. The coating applied to the web is virtually free of voids and gaps unlike nozzle sprays and other forms of applicators. There are no moving parts, other than the rotating applicator roll. In addition, the method is relatively insensitive to included air and small contaminants. As such, the apparatus and method of the invention are simple, economical and efficient means of applying a virtually flow-free continuous coating to the web.

What is claimed is:

1. The method of applying liquid coating material to a moving web of substrate material which comprises:
(a) forming on a moving surface at a position subjacent the web of substrate material a moving sheet of liquid coating material of substantially uniform velocity across its leading edge; and
(b) positioning a bar in the path of the moving sheet of coating material and subjacent the web of substrate material to deflect the leading edge of coating material upwardly from its course of travel so as to move in the direction of the substrate material and to form a free standing jet curtain of sufficient height and width to impinge on and coat the substrate material.

2. The method of claim 1 wherein the forming step comprises controlling the thickness and velocity of the sheet of coating material to provide a substantially uniform velocity across its width and thickness.

3. The method of claim 2 wherein the sheet of liquid coating material is formed on a rotating roll located subjacent the web of substrate material and the bar is positioned parallel and contiguous to the roll and intermediate the roll and the web of substrate material.

4. The method of claim 3 wherein the free standing jet forms an angle of at least 11° relative to vertical.

5. Apparatus for continuously applying a liquid coating material to a moving web of substrate material comprising:
(a) means for forming on a moving surface at a position subjacent the web of substrate material a moving sheet of liquid coating material of substantially uniform velocity across its leading edge, and
(b) means including a deflector bar positioned in the path of the moving sheet of coating material and subjacent the web of substrate material for deflecting the leading edge of the coating material from its course of travel to form a free standing jet curtain of sufficient height and width to impinge on and coat the substrate material.

6. Apparatus according to claim 5 including means for controlling the thickness and velocity of the sheet of coating material to provide a substantially uniform velocity across its width and thickness.

7. Apparatus according to claim 6 including a rotating roll on which the moving sheet of coating material is formed subjacent the web of substrate material, and wherein the deflector bar is positioned parallel and contiguous to the roll and intermediate the roll and web of substrate material.

8. Apparatus according to claim 7 including a metering device for controlling the thickness of the coating material positioned parallel and contiguous to the roll and upstream coating flow-wise of the bar.

9. Apparatus according to claim 8 wherein the bar includes a face constructed and arranged to upwardly deflect the leading edge of the coating material from its course of travel on the roll to form a free standing jet curtain at an angle of at least 11° relative to the vertical.

10. The apparatus of claim 9 wherein said face of the deflector bar is substantially vertical.

11. The apparatus according to claim 9 wherein the free standing jet curtain is at an angle from the vertical of 11° to 45°.

12. An apparatus according to claim 9 wherein said face of the deflector bar is between 1.7 and 2.5 times thicker than the thickness of said leading edge of said sheet of uniformly moving coating material.

13. An apparatus according to claim 9 wherein said deflector bar has along a front portion of a lower face of the bar an open small angle cut to improve lubrication between the bar and roll.

14. An apparatus according to claim 13 wherein the angle is 5° and the distance of the cut is less than one inch.

15. An apparatus according to claim 9 further comprising means for applying a torque to the bar to hold it in a fixed position relative to the roll.

16. An apparatus according to claim 9 or 11, or 12, or 13 wherein the deflecting face of the bar is substantially flat.

17. An apparatus according to claim 13 wherein said lower face of the bar is substantially tangent to said roll.

18. An apparatus according to claim 16 wherein said lower face of the bar is canted from a plane tangent to said roll at the line of deflection.

19. An apparatus according to claim 9, or 11, or 12, or 13 wherein said deflecting face of the deflector bar has two longitudinal flat portions, the lower one being adjacent to the roll and the upper one inclined at an angle between 11° and 45° towards the moving coating.

20. An apparatus according to claim 19 wherein said lower portion is perpendicular to the roll, and the upper portion is at an angle of 30°.

21. An apparatus according to claim 9, or 11, or 12, or 13 wherein said deflecting face of the deflector bar is concave along the thickness of the bar.

22. An apparatus according to claim 16 wherein said face is perpendicular to said roll.

23. An apparatus according to claim 9, or 11, or 12, or 13 wherein the angle between the incoming coating material to the bar and the coating material deflected from the bar in the formed jet is greater than 45° and less than 145°.

24. An apparatus according to claim 16 wherein said face is perpendicular to said roll.

25. An apparatus according to claim 9, or 11, or 12, or 13 wherein the angle between the coating material as it exists past the upper non-wetted surface of the bar is at least 45°.

26. In an apparatus for continuously coating a liquid material on a moving web of substrate material the improvement comprising:
(a) container means positioned subjacent said web for storing a supply of said coating material and having an open end thereof;
(b) an applicator roll positioned within said container means and having a portion of the outer surface thereof at least partially submerged in said supply of coating material;
(c) a metering blade positioned on one side of and across said roll adjacent to said submerged coating material;
(d) a deflecting bar positioned on and across an unsubmerged portion of said roll and adjacent to said metering blade and proximate to said substrate, but space therefrom;
(e) means for rotating said roll about its longitudinal axis so that said outer surface continuously passes through said supply of coating material, said coating material being carried on the roll past said metering blade to thereby form a stream of coating material uniformly moving on the outer surface of said roll between said metering blade and said deflecting bar and to thereby cause said uniformly moving coating material to impinge upon said deflecting bar and be deflected upwardly to form a free standing jet curtain toward and onto said substrate material thereby to provide a continuous coating on said substrate material.

27. Method according to claim 1, or 2, or 3, or 4 wherein said web of substrate material is selected from the group consisting of paper, paperboard or film.

28. Method according to claim 1, or 2, or 3, or 4, wherein said web of substrate material is paper.

* * * * *